US005174752A

United States Patent [19]

Chadwick

[11] Patent Number: 5,174,752

[45] Date of Patent: Dec. 29, 1992

[54] SUPPORT UNITS

[75] Inventor: Robert Chadwick, Stoke-on-Trent, England

[73] Assignee: Foseco International Limited, Birmingham, England

[21] Appl. No.: 692,621

[22] Filed: Apr. 24, 1991

[30] Foreign Application Priority Data

May 15, 1990 [GB] United Kingdom ..... 9010864

[51] Int. Cl.[5] ..... F27D 5/00

[52] U.S. Cl. ..... 432/258; 206/505; 206/507; 432/259

[58] Field of Search ..... 220/505, 507; 432/258, 432/259

[56] References Cited

U.S. PATENT DOCUMENTS

| | | | |
|---|---|---|---|
| 2,599,727 | 6/1952 | Schmidt | 220/97 |
| 3,052,373 | 9/1962 | Frater | 220/97 |
| 3,948,594 | 4/1976 | Irwin, Jr. | 432/259 |
| 4,000,997 | 2/1977 | Krasl | 432/258 |
| 4,219,328 | 8/1980 | Pasco et al. | 432/253 |
| 4,362,507 | 12/1982 | Antonucci | 432/259 |
| 4,441,615 | 4/1984 | Goodrich | 206/505 |
| 4,457,433 | 7/1984 | Wilson | 206/505 |
| 4,504,224 | 3/1985 | Hewitt | 432/258 |

FOREIGN PATENT DOCUMENTS

| | | |
|---|---|---|
| 0004027 | 9/1979 | European Pat. Off. . |
| 2311816 | 9/1973 | Fed. Rep. of Germany . |
| 3230253 | 2/1984 | Fed. Rep. of Germany . |
| 820036 | 10/1937 | France . |
| 1374378 | 6/1963 | France . |
| 1382251 | 11/1963 | France . |
| 2192947 | 2/1974 | France . |
| 2357845 | 7/1976 | France . |
| 2645632 | 10/1990 | France . |
| 2183805 | 6/1987 | United Kingdom . |

*Primary Examiner*—Henry C. Yuen
*Attorney, Agent, or Firm*—Nixon & Vanderhye

[57] ABSTRACT

A support unit, e.g. a setter, is designed for convenience of stacking both in use and in the stored condition. Each unit (10, 20, 20A) is of circular plan outline and has a rim (13) having alternate upwardly-and downwardly-disposed castellations (14 and 15 respectively) whereby a pair of units (20, 20A) can be stacked closely together with their upper castellations (24, 24A) contiguous and their lower castellations (25, 25A) contiguous or can be stacked in the 'use' position with the lower castellations (25A) of an upper unit (20A) resting on the upper castellations (24) of a lower unit (20).

10 Claims, 2 Drawing Sheets

SUPPORT UNITS

This invention relates to support units and particularly to units having a construction designed to improve their stacking. It is of particular relevance to kiln furniture used in the manufacture of ceramic articles.

During manufacture, ceramic articles are fired at high temperatures and vitreous ware, for example, may be fired at temperatures in the range of 1000° C. to 1450° C. During the firing operation it is necessary to provide a support or supports for the articles and different types of known supports include refractory setters, batts, props and saggars. A setter, for example, is used to support and protect the shape of the ware from deformation and sagging as it passes through its vitreous, plastic stage during the heat treatment.

It will be appreciated, therefore, that the kiln furniture must itself be made of a highly refractory material to withstand the firing cycle of the article it is to support and it will usually be of a material, e.g. cordierite or silicon carbide or bound ceramic fibrous material, such that it requires a firing operation during its own manufacturing process.

In the case of a setter, for example, this may have a dished shape to conform generally to the shape of the piece of vitreous ware it is to support and each piece of vitreous ware may require its own specially-shaped setter to give it the desired support during its vitreous phase. Hence, manufacturers of vitreous ware need to carry large stocks of setters and their transport and storage can take up considerable space and, hence, be expensive.

The present invention, therefore, aims to provide a specially-shaped piece of kiln furniture, that is designed to fulfill all the requirements of conventional articles but to be more efficient in terms of space required for storage and, indeed, during its own firing cycle during its manufacture.

Accordingly, the invention provides a support unit which is of generally circular outline in plan, the periphery of the unit being provided with a rim in the form of alternate upwardly-disposed and downwardly-disposed castellations or steps, whereby a pair of units can in a first position be stacked closely together one on top of the other with the upper castellations of the one contiguous with the upper castellations of the other and the lower castellations of the one contiguous with the lower castellations of the other and in a second position can be mounted one on the other with the lower castellations of the upper unit resting on the upper castellations of the lower unit to provide space for the article to be supported by the lower unit.

It will be appreciated that a large number of the units can be stacked together in the first position to take up minimum storage space and that this is also of significant advantage when the units are being manufactured. The 'green' shaped units can be passed through a kiln or furnace to be fired while in this stacked configuration.

It is preferred that the periphery of the unit has a continuous rim, i.e. that there are no discontinuities between the upper and lower castellations but that the rim continues throughout to join upper and lower castellations together. This is important in giving strength and desired load-bearing properties to the supports. It is also preferred that the rim portions joining upper and lower castellations together should be at an angle other than normal to those castellations to provide easy stacking.

As indicated above, where the units are setters, they will normally be of dished form, the precise amount of dishing required being well established in the art for any particular piece of ware to be supported by the setter.

Kiln furniture of the invention may be made of any suitable refractory materials and by any suitable forming means. It is preferred, however, that they be made from bound ceramic fibre compositions. Particularly suitable compositions are described in our co-pending European Patent Application No. 90302378.6 (Publication No. 0395203.) These comprise ceramic fibres of aluminosilicate or alumina with a refractory ground particulate filler and a refractory reactive binder, the binder containing alumina and silica both of colloidal particle size. These compositions are preferably formed to the desired shape by first being made into a slurry and then vacuum-forming to the desired shape. A particularly suitable two-part forming technique is also described in our European Patent Application No. 90302378.6 (Publication No. 0395203) in which the slurry is first formed to a preform shape, the pre-form is pressed to the final required shape and is then fired.

The present invention will now be described by way of example only with reference to the accompanying drawings in which.

Figure 1:
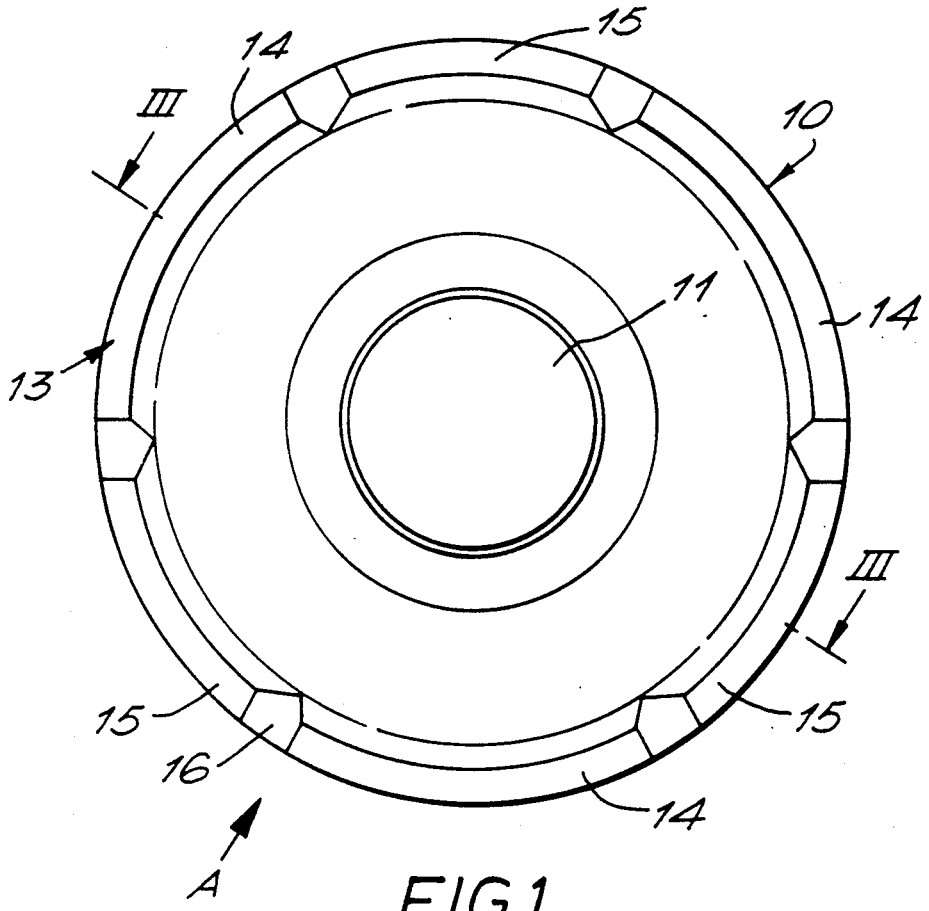
FIG. 1 is a plan view of a dished setter of the invention.
Figure 2:
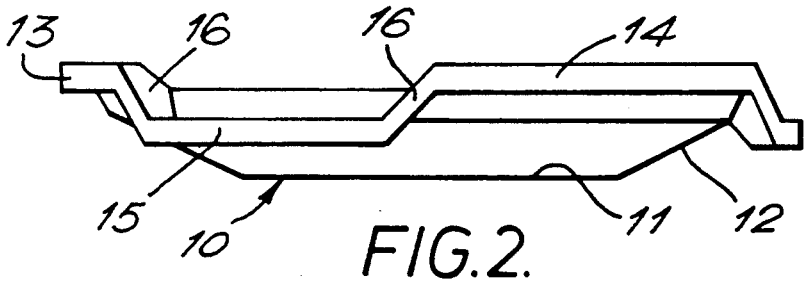
FIG. 2 is a view along line A of FIG. 1.
Figure 3:
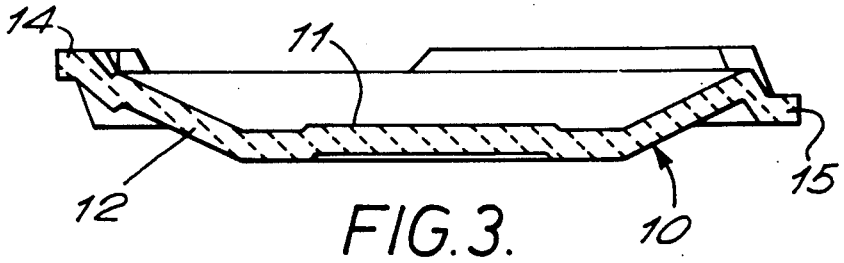
FIG. 3 is a section along line III—III of FIG. 1.

Referring to FIGS. 1 to 3, a setter 10 is of circular plan form having a dished shape with base portion 11 and sloping sidewall 12. The periphery of the setter has a continuous rim 13 which is formed in a series of upwardly-disposed castellations or steps 14 joined to alternate downardly-disposed castellations or steps 15 by angled rim portions 16. The setter is conveniently formed as an integral, one-piece unit by the aforementioned vacuum-forming of a slurry of suitable materials.

Figure 4:
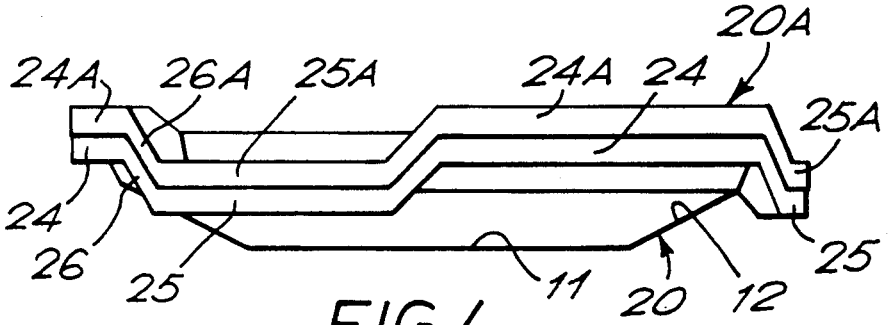
FIG. 4 is a perspective view of a pair of setters of the type shown in FIG. 1 in their stacked, i.e. first position, configuration.

Referring to FIG. 4, two identical setters 20 and 20A are shown in the stacked configuration, 20A nestling snugly in the dished recess of 20 defined by base 11 and sidewalls 12. The corresponding upper castellations 24 and 24A of the two setters lie in contact or closely contiguous as do the corresponding lower castellations 25 and 25A and the angled rim portions 26 and 26A. Sloping sidewalls 12 and base 11 of the upper setter 20A rest on and are supported respectively by the sloping sidewalls 12 and base 11 of the lower setter 20.

Figure 5:
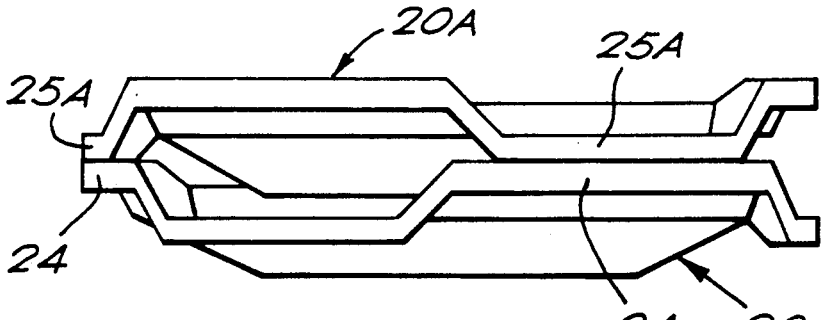
FIG. 5 is a similar view showing the pair in their use mode, or second position, i.e. spaced apart to support a piece of vitreous ware (not shown) in the lower one.

FIG. 5 shows the two setters of FIG. 4 in their second, i.e. use, mode. Here, setter 20A has been positioned to rest on top of setter 20 so that contact is made only between the lower castellations 25A of the upper setter and the upper castellations 24 of the lower setter. Thus a piece of ware to be fired can be carried in setter 20 before setter 20A is placed in this use mode. Similarly, further setters may be placed one on top of setter 20A and so on to provide the required number of supports for a single stack of items to be fired.

In another embodiment the upper surface of the lower castellations and the lower surface of the upper castellations can be provided with co-operating slots and protruberances respectively (or vice versa) so that in the 'use' mode the adjacent units can be effectively locked together to prevent displacement.

I claim:

1. A support unit for use as kiln furniture, comprising:

a substantially circular support unit having a base portion, and a sidewall extending generally upwardly from the base and connected to said base along one end, said support unit further having a periphery connected to the sidewall along a second end and extending circumferentially about the support unit;

a series of upwardly and downwardly extending castellations disposed about the periphery so that at least first and second support units may be stacked together one on top of the other in one of a first or second position;

the upwardly extending castellations of the first support unit receiving the upwardly extending castellations of the second support unit and the downwardly extending castellations of the second support unit receiving the downwardly extending castellations of the first support unit in said first position to form a nestable stack; and the downwardly extending castellations of the first support unit being supported by the upwardly extending castellations of the second support unit in said second position to form a support space to receive an article to be fired.

2. A support unit according to claim 1, in which the periphery of the unit has a continuous rim.

3. A support unit according to claim 2, in which the continuous rim joins together adjacent upper and lower castellations by means of rim portions that are at an angle other than normal to said castellations.

4. A support unit according to claim 1, which is of dished form.

5. A support unit according to claim 3 wherein an upper surface of the lower castellations and a lower surface of the upper castellations are provided with cooperating slots and protuberances so that successive units may be locked together.

6. A support unit according to claim 1, which is made of a bound ceramic fibres composition.

7. A support unit according to claim 6, in which the ceramic fibres are selected from aluminosilicate and alumina.

8. A support unit according to claim 6, in which the ceramic fibres are bound by a binder containing silica and alumina both of colloidal particle size.

9. A support unit according to claim 1, which has been made by preparing a slurry of the desired composition, and the slurry has been vacuum-formed to the desired shape followed by firing.

10. A support unit according to claim 1 further comprising green support units stacked in said second position while being fired during manufacturing of the support units.

* * * * *